United States Patent [19]

Overmyer et al.

[11] 4,089,108

[45] May 16, 1978

[54] FILTER SLEEVE STUFFING MACHINE

[75] Inventors: Richard C. Overmyer, Francesville; Mario Guerra, Zionsville, both of Ind.

[73] Assignee: Francesville Drain Tile Corporation, Francesville, Ind.

[21] Appl. No.: 765,249

[22] Filed: Feb. 3, 1977

[51] Int. Cl.[2] ..... A22C 13/00

[52] U.S. Cl. ..... 29/820; 53/197

[58] Field of Search ..... 29/728, 819, 820; 53/13, 197; 206/69, 303, 802; 17/41, 42; 93/84 TW, 93 HT

[56] References Cited

U.S. PATENT DOCUMENTS

| | | | |
|---|---|---|---|
| 1,761,189 | 6/1930 | Brennan et al. | 53/197 |
| 3,745,611 | 7/1973 | Patouillard | 53/197 |

*Primary Examiner*—Lowell A. Larson

*Attorney, Agent, or Firm*—Jenkins, Coffey & Hyland

[57] ABSTRACT

A machine for gathering and packing a long length of filter sleeve, e.g. 500 feet, onto a short cartridge tube, e.g. 5 feet, for subsequent dispensing therefrom onto a continuous length of soil drainage tubing as such tubing is laid in the ground. The cartridge tube with a collar at its rear end is supported on an elongated support bar, against a backing collar held by a frictional brake. A continuous length of filter sleeve is fed over the cartridge tube and is gathered by a pair of rubber-tired gathering wheels, which are mounted so as to progress along the tube against an opposing bias as the gathering progresses. When a suitable length of sleeve has been gathered by the wheels onto a partial length of the tube, a packer collar is forced against the gathered sleeve, the wheels being retracted, so as to pack the sleeve on the cartridge tube and against the cartridge collar or the previously packed sleeve. When the desired packing force is attained, further force of the packing collar overcomes the braking force holding the backing collar, and drives the cartridge tube and the backing collar rearward along the support bar, to present a new length of the cartridge tube for the gathering operation. Alternate gathering and packing is continued until the cartridge tube is filled.

15 Claims, 6 Drawing Figures

FILTER SLEEVE STUFFING MACHINE

BACKGROUND OF THE INVENTION

In our prior U.S. Pat. No. 4,003,122, granted Jan. 18, 1977 and our co-pending application Ser. No. 723,238, filed Sept. 15, 1976 we disclose a method and apparatus for dispensing a long length of filter sleeve from a packed cartridge tube onto a continuous length of soil drainage tubing as such tubing is laid in the ground. The present invention provides apparatus for gathering and packing, i.e. stuffing, continuous lengths of filter sleeve onto cartridge tubes for such use. Typically, up to 500 feet or more of filter sleeve is packed onto a 5-foot cartridge tube or dispenser tube.

SUMMARY OF THE INVENTION

In accordance with the invention, a continuous length of filter sleeve or the like is gathered and packed on a cartridge tube and against a stop at one end thereof. The tube is supported, as in a horizontal position, to receive a length of filter sleeve over one end and along the length of the cartridge, and to resist axial thrust exerted during the gathering operation. A plurality of gathering wheels are spaced circumferentially about the cartridge, and are driven to move the sleeve lengthwise on the tube and gather it behind the wheels. The wheels are mounted so that as they meet resistance from the already gathered sleeve, they will progress forward along the tube to gather material over a considerable length thereof. Such forward progression is opposed by a predetermined biasing force which has the effect of controlling the density with which the sleeve material is gathered.

When a quantity of sleeve material has been gathered on the cartridge tube by the wheels, a packer collar is advanced against the gathered sleeve, and exerts thrust thereon to pack it tightly against the end stop, or against previously packed material. The tube is mounted for axial movement in the direction of packer thrust, but is connected to a brake which resists such movement. The arrangement is such that after the desired packing thrust has been attained, the brake resistance is then overcome. Further thrust of the packer then causes the cartridge tube to move against the brake resistance and thereby move the packed portion of the cartridge tube past the position of the gathering wheels and present a new length of tube to such wheels. The alternate gathering and packing operations proceed until the cartridge tube is fully packed. The sleeve is then cut and its end secured to the cartridge tube, as with a band of tape.

Further features and advantages of the invention will appear from the following description of an exemplifying and preferred embodiment, and by the accompanying drawings showing such embodiment.

BRIEF DESCRIPTION OF THE DRAWINGS

The accompanying drawings illustrate the invention. In such drawings.

DETAILED DESCRIPTION OF THE PREFERRED EMBODIMENT

Figure 1:
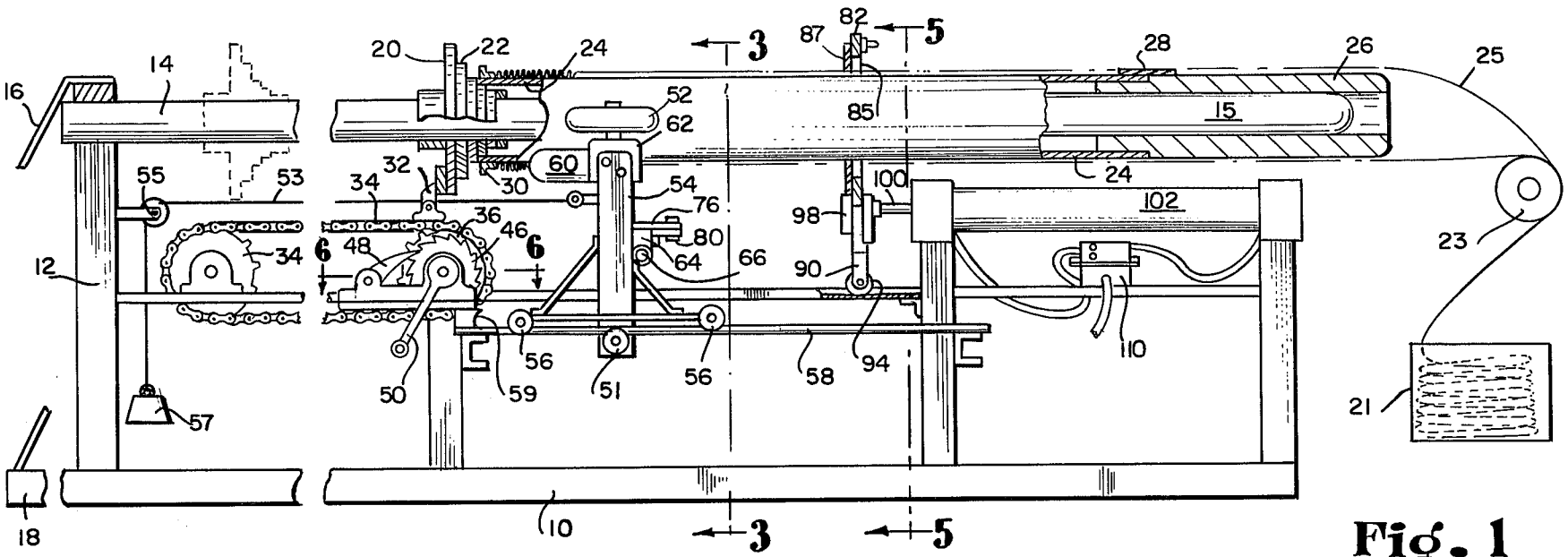
FIG. 1 is a side elevation of a gathering and packing machine in accordance with the invention, with parts broken away.

The apparatus shown in the drawings comprises a frame 10 having a main upright 12 at its left end which supports a support bar 14. The support bar 14 extends as a cantilever beam having a relatively long overhang, hence the upright 12 is preferably braced by angle braces 16 extending between the top of the upright 12 and extensions 18 of the bottom members of the frame 10. The support bar 14 carries a slidable backing collar 20 which has four stepped shoulders 22 at its face for supporting different sizes of cartridge tubes 23. The cartridge tube 24 carries a stop collar 30 at its left end where it engages over one of the shoulders 22. The opposite end of the tube 24 is supported on the remote end 15 of the support bar by a slidable extension nose 26 of the same size as the particular cartridge tube 24 being used. The extension nose 26 has a reduced-diameter end which fits within the tube 24 and the nose is temporarily fixed to the cartridge tube 24 by a piece of pressure sensitive adhesive tape 28. The tube 24 is thus supported coaxially on the support bar 14 and is free to slide longitudinally of the support bar 14 under the control of the backing collar 20.

Figure 6:
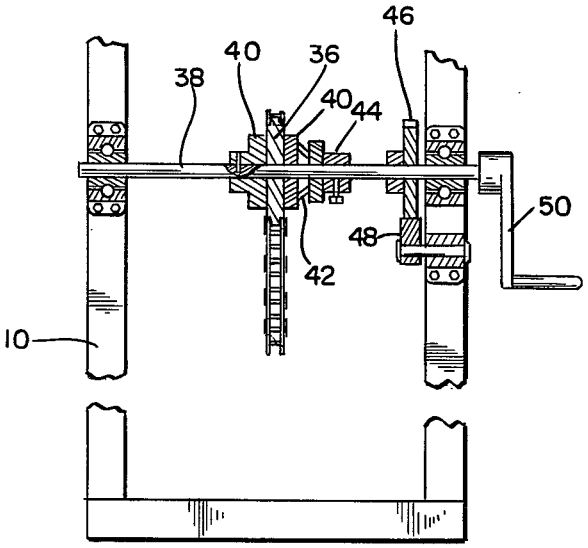
FIG. 6 is a fragmental horizontal section taken on the line 6—6 of FIG. 1 and showing the frictional braking and return mechanism for the backing collar.

The backing collar 20 is connected at the bottom to a bracket 32 on a link in the top stretch of a control chain 34. Such control chain is stretched about an idler sprocket or pulley 34 and a control sprocket 36. As shown in FIG. 6, the control sprocket 36 is loosely mounted on a ratchet shaft 38 and is engaged at its opposite faces by a pair of brake pads 40. These are yieldingly and adjustably pressed against the sprocket 36 by a spring washer 42 mounted between one of such brake pads and an adjustable stop 44 on the shaft 38. The shaft 38 also carries a ratchet wheel 46 fixed thereto and engaged by a dog 48, and is rotatable by a crank 50. The arrangement is such that a predetermined pressure against the backing collar 20 tending to thrust the backing collar to the left as shown in FIG. 1 will cause such backing collar 20 to retract to the left against the frictional braking force applied by the brake pads 40 to the control sprocket 36. The crank 50 can be operated to return the backing collar 20 to its normal position as shown in FIG. 1.

A supply container of filter sleeve 25 is located beyond the end of the support bar 14 and cartridge nose 26, and the sleeve is fed over a guide roller 23 and thence over the nose and cartridge 24.

Figure 2:
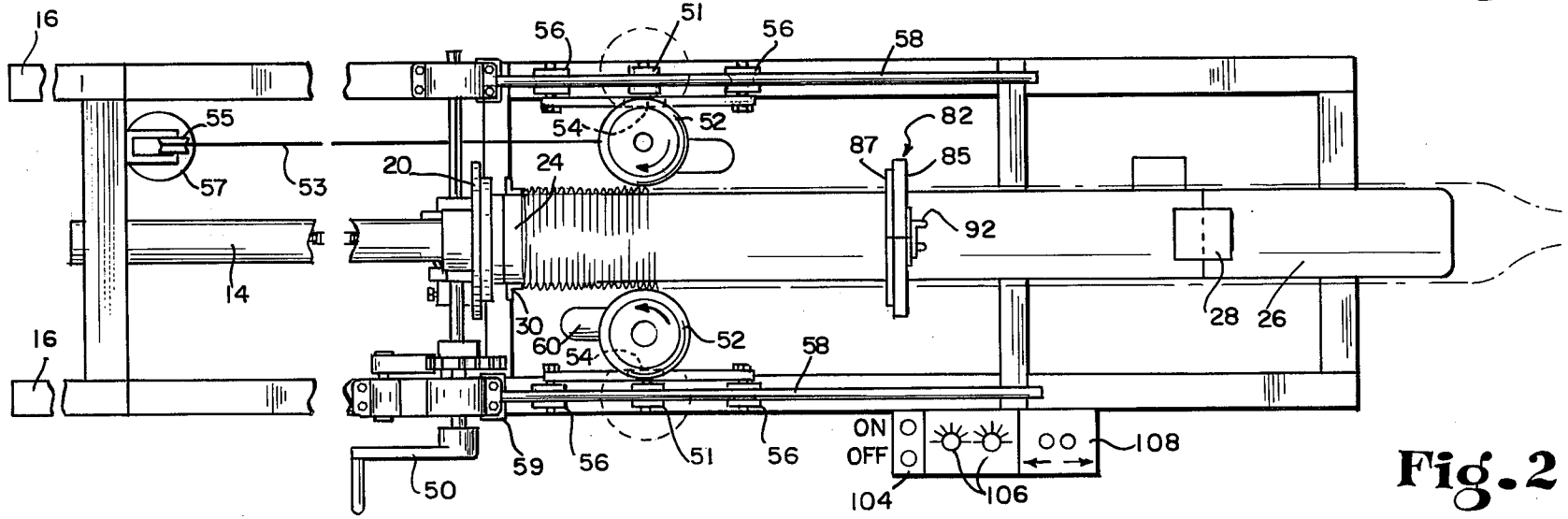
FIG. 2 is a plan view of the machine shown in FIG. 1.

A pair of gathering wheels 52 are mounted on uprights 54 so as to bear against the sleeve on opposite sides of the cartridge tube 24. The uprights are mounted by spaced support wheels 56, and retained by intermediate retaining wheels 51, on two cylindrical rails 58 at the two sides of the frame 10. The wheels 56 and 51 are grooved to mate with the surface of the rails 58, so as to retain themselves on the rails while permitting the wheel-supporting uprights 54 to swing in a vertical plane toward and away from the cartridge tube 24. Each gathering wheel 52 is driven by its own motor 60 through a gear box 62, and as shown in FIG. 2, the drives are arranged to drive the two wheels 52 in opposite directions so that their inner peripheries move toward the stop collar 30 on the cartridge tube 24.

Figure 3:
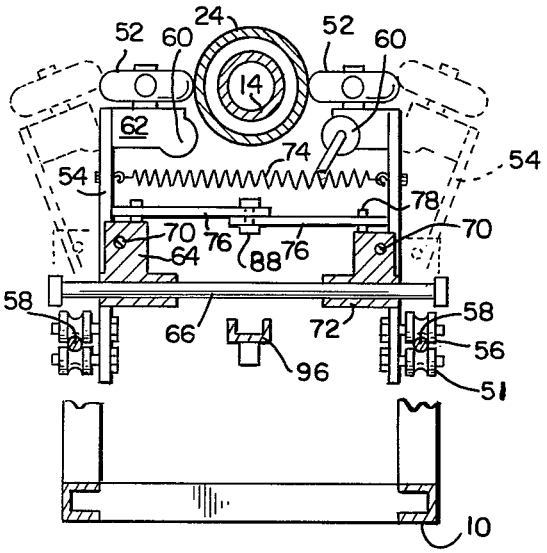
FIG. 3 is a transverse section taken on the line 3—3 of FIG. 1.

For purposes of maintaining the two wheel-supporting uprights 54 in transverse alignment while allowing them to swing inward and outward, such uprights 54 are connected by pivot blocks 64 to a tranverse coupling bar 66. As shown in FIG. 3, a pivot block 64 is pivoted to each upright 54 by a longitudinal pin 70, and each block includes an elongated sleeve 72 which is slidably engaged with the coupling bar 66. The arrangement interconnects the two uprights 54 for coordinate movement along the rails 58, as the side members of a unitary carriage, while allowing those side members 54 to swing inward and outward, as shown in full and broken lines in FIG. 3. The carriage is pulled to the left in FIG. 1, toward that end of the cartridge tube 24 which carries the collar 30, by a cable 53 which runs over a fixed idler pulley 55 to a weight 57. Such cable and weight allows the wheels to progress along the tube as sleeve gathering progresses, and applies a predetermined bias against such movement so as to regulate the gathering force applied by the wheels and hence the density with which the sleeve is gathered. In FIGS. 1 and 2, the carriage and wheels 52 are shown in a partially progressed position spaced to the right from the stops 59 at the left end of the rails 58.

Figure 4:
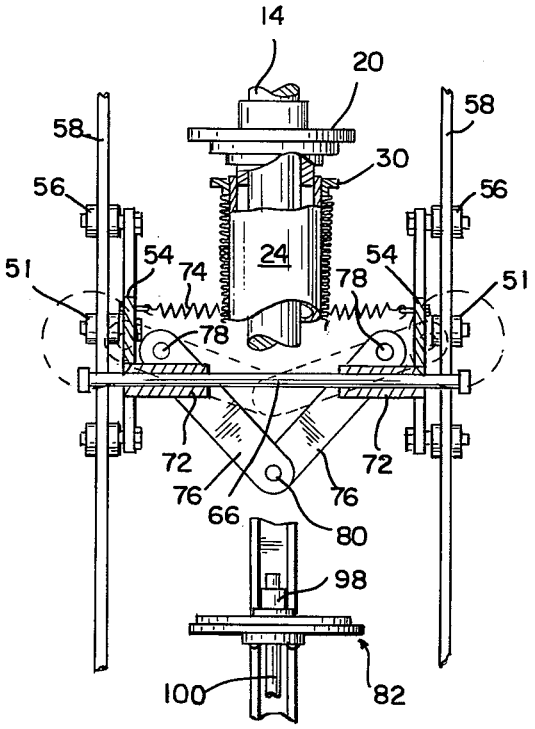
FIG. 4 is a fragmentary plan view of a center portion of the machine shown in FIGS. 1 and 2, showing the mechanism for retracting the gathering wheels when the packing collar is advanced.

The two wheel-carrying uprights are normally pulled together by a tension spring 74, so that the gathering wheels 52 are pulled toward each other and against the sides of the cartridge tube 24, so as to frictionally engage sleeve material fed over that cartridge tube and gather it on that tube. The two uprights 54 are arranged to be thrust apart to the retracted positions shown in dotted lines in FIGS. 3 and 4, by a pair of toggle links 76. These are articulated at their ends to the uprights, as by being engaged over upstanding pivot pins 78 on the pivot blocks 64 attached to the uprights 54, and are interconnected with each other by a center link pin 80. The links 76 are normally at a small angle to each other as shown in full lines in FIG. 4. If their center connection at the link pin 80 is pushed longitudinally of the machine, the links swing away from each other and push the wheel-carrying uprights 54 outward, as to the positions shown in dotted lines in FIGS. 3 and 4, where the wheels 52 are disengaged from the sleeve material on the cartridge tube 24 and provide a clear path for operation of the packer collar 82 described below. The links 76 may be arranged to swing past dead center against a stop, so as to lock the uprights 54 and wheels 52 in outward spaced position during the packing operation.

Figure 5:
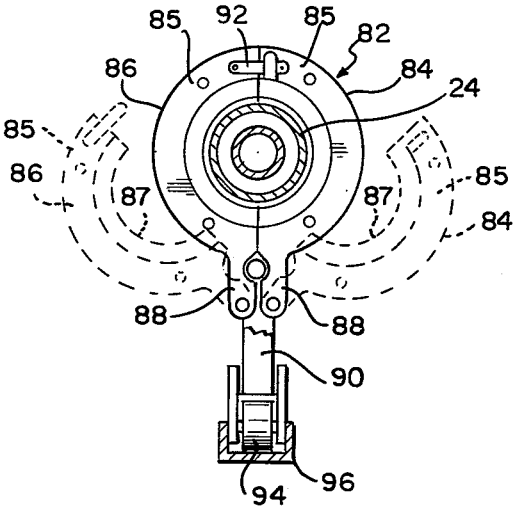
FIG. 5 is a partial section taken on the line 5—5 of FIG. 1 and showing the packing collar.

As shown in FIGS. 1 and 5, the packer collar 82 forms a ring about the cartridge tube 24, with the inner periphery of the ring having sufficient clearance from the cartridge tube to permit free passage of the filter sleeve 25 as such filter sleeve is pulled along the surface of the cartridge tube 24 in the gathering operation. As shown in FIG. 5, the packer collar 82 is desirably formed of a pair of semicircular ring sections 84 and 86 which have lugs 88 at their lower ends by which they are pivotally mounted on a carriage leg 90. With such pivotal mounting, the two sections are movable from a closed position as shown in full lines in FIG. 5, where they are retained by a latch lever 92, to an open position shown in dotted lines where they stand clear of the cartridge tube 24 to permit removal of a filled cartridge tube and its replacement by an empty tube, and where they facilitate initial threading of the filter sleeve 25 onto the cartridge tube 24 as a gathering operation begins. The packer collar is supported for movement longitudinally of the cartridge tube 24 by a supporting wheel 94 at the bottom of the leg 90. Such wheel rides in a channel track 96 extending toward and past the position of the gathering wheels 52.

To adapt the packer collar for use with cartridge tubes of different size, each semicircular section desirably consists of an outer section 85 having an inner periphery of a size to suit the largest cartridge tube to be used, and is arranged to receive a selected insert 87 removably fixed to the front face of the outer section and providing an inner periphery of a size to suit a smaller cartridge tube.

The packer collar 82 is arranged to be thrust to the left from its position as shown in FIGS. 1 and 2 toward the carriage formed by the wheel-carrying uprights 54. For this purpose, the packer collar 82 is connected to the end of the piston rod 100 of a double-acting air cylinder 102, having a stroke sufficient to move the packer collar 82 from its position shown in full lines in FIGS. 1 and 2 toward the normal position of the carriage for the gathering wheels 52. To actuate the toggle links 76 of the carriage, the packer collar 82 carries a bumper pad 98 at its front face.

Controls are provided for the wheel drive motors 60 and air cylinder 102. As shown in FIG. 2, these include On/Off switches 104 for controlling both motors jointly, and two separate variable speed controls 106 for the two motors. The controls also include two manual hold-down switch buttons 108 which actuate solenoid valves in a valve chest 110 for operating the air cylinder 102 in opposite directions.

Operation is as follows. An empty cartridge tube 24 is placed over the support bar 14, and its collar end is placed over the appropriate size flange 22 on the backing collar 20, with that backing collar 20 positioned in its foremost position as shown in full lines in FIG. 1. Mounting of the cartridge tube 24 is facilitated by locking the gathering wheels in retracted position and by opening the packer collar 82 so that its two sections 84 and 86 are in their open positions as shown in dotted lines in FIG. 5. The collar is fitted with inserts 87 to match the size of the cartridge tube 24. An extension nose 26 is placed over the free end 15 of the support bar 14 engaged with the free end of the cartridge tube 24, and secured to such cartridge tube as by a piece of tape 28. A length of filter sleeve 25 is led from the supply container 21 over the guide roller 23 and slipped over the extension nose and along the length of the cartridge tube 24, until its end is located against the stop collar 30. The gathering wheels 52 are then placec against the sleeve at the sides of the cartridge tube 24 and their motors are energized to drive the wheels in a direction to propel and gather the filter sleeve 25 along the cartridge tube 24 toward and against the stop collar 30. As the gathered material builds up on the cartridge tube 24 and against the wheels, it offers resistance to the wheels 52 and causes them to progress along the tube 24, against the bias exerted by the cable 53 and weight 57. The weight thus controls the tightness with which the filter sleeve is gathered. When a quantity of sleeve has been gathered over an initial length of the tube and the wheels 52 and their carriage have suitably progressed to the right past the position shown in FIG. 1, the packer collar 82 is advanced to pack the gathered material in a tight mass against the stop collar 30. Such advance of the packer collar 82 is effected by manually depending the hold-down switch button 108 to actuate the air cylinder to the left as seen in FIG. 1. This carries the packer collar assembly to the left. As it approaches the wheels 52, its bumper 98 pushes against the center of the toggle links 76, which causes those links to swing apart and thrust the uprights 54 outward so as to retract the gathering wheels 52 from engagement with the filter sleeve on the cartridge tube 24. The wheels may be stopped during this operation by de-energizing the motors 60, but with the parts suitably coordinated this may not be necessary. The disengagement of the wheels from the gathered material allows the gathering wheel carriage to be pulled to the left by the cable 53 and the weight 57. When the gathering wheel carriage is in fully retracted position, movement of the air cylinder bumper 98 against the center of the toggle links 76 may be arranged to move those links past dead center to a locking position, where they hold the gathering wheels in widely retracted positions.

When the filter sleeve gathered on the cartridge tube 24 by the gathering wheels 52 has been packed tight by the packer collar 82, its resistance to further packing will exceed the resistance to movement of the packer collar 82 provided by the brake 36–40. When this occurs, further thrust movement of the packer collar 82 will overcome the frictional braking resistance of the brake pads 40 against the sprocket 36 of the positioning chain 34, and the packer collar thrust will then act, through the gathered and packed filter sleeve and the stop collar 30, to drive that backing collar 20 to the left from the position shown in full lines in FIG. 1, toward the position shown in dotted lines in FIG. 1, a distance depending on the amount of packed sleeve. This will move the cartridge 24 lengthwise to present a new portion of its length to the gathering wheels. The packer collar 82 is then retracted by manually depressing the switch button 108 to drive the air cylinder to the right. The toggle links 76 may then be unlocked and swung to their collapsed position so that the gathering wheels 52 against engage the filter sleeve on the cartridge tube 24. Because of the movement of the backing collar 20 described above, the gathering action of the gathering wheels 52 will occur at a new point along the length of the cartridge tube, will gather a second length of filter sleeve onto a second portion of the length of the cartridge tube, and will gather it against the filter sleeve material previously gathered and packed in the previous step of the operation.

The gathering will proceed as before, and the gathering wheels 52 will progress along the new length of cartridge tube until an appropriate amount of filter sleeve material has been gathered ready for a new packing operation. The packer collar 82 is then actuated in the same manner as before, to move it lengthwise of the cartridge tube 24 and against the toggle links 76, and the drive of the gathering wheels will be interrupted. The packer collar will then pack the newly-gathered length of filter sleeve against the previously packed material, and may again move the cartridge tube and its backing collar 20 rearward against the brake resistance, so as to present a new length of the cartridge tube for gathering and packing.

This procedure is continued until the entire length of the cartridge tube has been filled with gathered and packed filter sleeve material. The filter sleeve is then cut off at the end of the cartridge tube and its end suitably secured, as by means of a band of tape. The extension nose 26 is then removed from the cartridge tube and the support bar 14. This leaves the cartridge tube 24 ready for removal from the support bar together with the filter sleeve packed thereon, as a completed cartridge ready for packaging and delivery for use in accordance with the disclosures of U.S. Pat. No. 4,003,122.

In preparation for gathering and packing filter sleeve on a new cartridge tube, the backing collar 20 is advanced to its normal position as shown in full lines in FIG. 1, by turning the crank 50 to rotate the shaft 38 and the sprocket 36. A new cartridge tube 24 is placed over the support bar 14 together with an extension nose 26, and the gathering and packing operation described above is repeated.

We claim:

1. Apparatus for gathering and packing a length of filter sleeve material or the like on a cartridge tube and against a stop at one end thereof, comprising means to support the cartridge to receive a length of sleeve material over one end and along its length toward its stop end thereof and to resist axial thrust toward its stop end, a plurality of gathering wheels spaced circumferentially about the cartridge for engaging the sleeve thereon and means to drive the wheels to gather the sleeve material toward the stop end of the cartridge, and packer means for engaging the gathered sleeve material and exerting thrust thereon toward the stop end of the cartridge to pack the gathered material on the cartridge, said packer means being movable along the cartridge tube toward the wheels, and said wheels being retractable to clear the path of the packer means.

2. Apparatus for gathering and packing a length of filter sleeve material or the like on a cartridge tube and against a stop at one end thereof, comprising means to support the cartridge to receive a length of sleeve material over one end and along its length toward its stop end thereof and to resist axial thrust toward its stop end, a plurality of gathering wheels spaced circumferentially about the cartridge for engaging the sleeve thereon and means to drive the wheels to gather the sleeve material toward the stop end of the cartridge, and packer means for engaging the gathered sleeve material and exerting thrust thereon toward the stop end of the cartridge to pack the gathered material on the cartridge, said packer means comprising a packer collar surrounding the cartridge, normally spaced axially of the cartridge from the wheels, and movable toward the wheel position in its packing operation.

3. Apparatus as in claim 2 in which said whels are retractable to clear the path of the packer means and the packer means is movable into the position of the wheels.

4. Apparatus for gathering and packing a length of filter sleeve material or the like on a cartridge tube and against a stop at one end thereof, comprising means to support the cartridge to receive a length of sleeve material over one end and along its length toward its stop end thereof and to resist axial thrust toward its stop end, a plurality of gathering wheels spaced circumferentially about the cartridge for engaging the sleeve thereon and means to drive the wheels to gather the sleeve material toward the packer means for engaging the gathered sleeve material and exerting thrust thereon toward the stop end of the cartridge to pack the gathered material on the cartridge, said gathering wheels being relatively movable in progression along the length of the cartridge as their gathering action processes, so as to gather additional material against that already gathered, and biasing means opposing such wheel progression, said cartridge-supporting means supporting the cartridge for axial movement, and means yieldingly resisting such axial movement, said resisting means being independent of said biasing means and actuating means for said packer means operative to exert packing thrust in excess of the resistance of said resisting means, so as to move the cartridge axially as sleeve material is packed thereon and thereby present a new length of cartridge for the reception of additional sleeve material.

5. Apparatus as in claim 4 in which said wheels are mounted on a carriage movable axially of the cartridge, and said biasing means acts on said cartridge.

6. Apparatus as in claim 5 in which said biasing means comprises a weight operative to exert a constant bias on the wheels throughout their progression.

7. Apparatus for gathering and packing a length of filter sleeve material or the like on a cartridge tube and against a stop at one end thereof, comprising means to support the cartridge to receive a length of sleeve material over one end and along its length toward its stop end thereof and to resist axial thrust toward its stop end, a plurality of gathering wheels spaced circumferentially about the cartridge for engaging the sleeve thereon and means to drive the wheels to gather the sleeve material toward the stop end of the cartridge, and packer means for engaging the gathered sleeve material and exerting thrust thereon toward the stop end of the cartridge to pack the gathered material on the cartridge, said gathering means comprising a collar surrounding said cartridge and spaced axially of the cartridge from said wheels, said wheels being movable in progression along the cartridge toward said packer collar in response to resistance from already gathered material, said packer collar being movable toward said wheels to pack the material gathered thereby, and means to retract the wheels to clear the path of the packer collar.

8. Apparatus as in claim 7 with the addition of biasing means opposing the progression of the wheels in response to gathering resistance, so as to increase the density with which the material is gathered by the wheels, said cartridge being supported for axial movement, means yieldingly resisting such movement with a force greater than said wheel biasing means so as to prevent cartridge movement in response to action of said gathering wheels, and actuating means for said packer means operative to exert packing thrust in excess of the resistance of said resisting means, so as to move the cartridge axially as sleeve material is packed thereon and thereby present a new length of cartridge to said gathering wheels.

9. Apparatus for gathering and packing a length of filter sleeve material or the like on a cartridge tube and against a stop at one end thereof, comprising means to support the cartridge to receive a length of sleeve material over one end and along its length toward its stop end thereof and to resist axial thrust toward its stop end, a plurality of gathering wheels spaced circumferentially about the cartridge for engaging the sleeve thereon and means to drive the wheels to gather the sleeve material toward the stop end of the cartridge, packer means for engaging the gathered sleeve material and exerting thrust thereon toward the stop end of the cartridge to pack the gathered material on the cartridge, and mounting means for said gathering wheels supporting the same for movement beween their operative position engaging the sleeve and a retracted position to clear the packer means, drive means for said packer means, and actuating means for actuating said mounting means to retract the wheels in response to operation of said packer drive means.

10. Apparatus as in claim 9 in which said wheel mounting means comprises a pair of uprights supporting the wheels at their upper ends and pivotally movable to carry the wheels outward from their operative positions to their retracted positions, means resiliently urging said uprights inward, said packer drive means including a member movable longitudinally toward the wheel position, and upright-actuating means actuated by longitudinal movement of said member for swinging the uprights outward to retract the wheels.

11. Apparatus as in claim 10 in which said upright-actuating means comprises a pair of toggle links connected at their ends to said uprights and positioned with their center pivot in the path of said packer drive member.

12. Apparatus for gathering and packing a length of filter sleeve material or the like on a cartridge tube and against a stop at one end thereof, comprising means to support the cartridge to receive a length of sleeve material over one end and along its length toward its stop end thereof and to resist axial thrust toward its stop end, a plurality of gathering wheels spaced circumferentially about the cartridge for engaging the sleeve thereon and means to drive the wheels to gather the sleeve material toward the stop end of the cartridge, packer means for engaging the gathered sleeve material and exerting thrust thereof toward the stop end of the cartridge to pack the gathered material on the cartridge, said gathering wheels being relatively movable in progression along the length of the cartridge as their gathering action progresses, so as to gather additional material against that already gathered, and biasing means opposing such wheel progression, said cartridge being mounted for axial movement to present new lengths thereof to the gathering and packing mechanism, a backing member controlling the axial position of the cartridge, a chain or like tension member connected to the backing member, and a sprocket or the like about which the chain is engaged, a shaft for said sprocket, and frictional brake means connecting the sprocket to the shaft, and ratchet means to prevent rotation of the shaft in response to tension on the chain, said brake means being operable to yieldingly resist movement of said backing member under axial thrust imposed on said cartridge by said gathering wheels but to allow axial movement thereof and the cartridge under thrust from said packer means in excess of predetermined packing thrust, so as to permit axial movement of the cartridge by said packing means when a predetermined packing thrust has been attained.

13. Apparatus for gathering and packing sleeve material or the like on a cartridge tube and against a stop at one end thereof, comprising means to support the cartridge to receive a continuous length of sleeve material over one end and along its length toward its stop end and providing for axial movement of the cartridge, a plurality of gathering wheels spaced circumferentially about the cartridge for engaging the sleeve thereon and gathering such sleeve on the cartridge, said wheels being progressively movable over a portion of the length of the cartridge so as to gather sleeve material on such portion while the cartridge remains stationary, and means for engaging the gathered sleeve material and exerting thrust thereon to pack such gathered material on the cartridge, and for axially moving the cartridge on which such material has been packed so as to present a new length of cartridge to the gathering wheels.

14. Apparatus for gathering and packing a length of filter sleeve material or the like on a cartridge tube and against a stop at one end thereof, comprising a support bar having a backing collar thereon and adapted to receive and support a cartridge thereon against the backing collar, a carriage and a pair of gathering wheels mounted thereon at opposite sides of the bar and having operative positions for engaging a filter sleeve extending lengthwise over the cartridge, and means to drive the wheels to gather such sleeve on the cartridge toward the backing collar, said cartridge being movable axially of the support bar to carry said sheels progressively along a length of the cartridge in response to resistance presented to the wheels by the gathered material, a packer collar having a retracted position about the support bar in which it clears the cartridge and the sleeve moving along the cartridge to the gathering wheels, said packer collar being movable axially toward the backing collar on the support bar so as to engage and exert thrust on the gathered sleeve material and pack the same on the cartridge, said backing collar being movable axially along the support bar to carry the packed portion of the cartridge beyond the wheels and thereby present a new length of the cartridge to the gathering wheels.

15. Apparatus as in claim 14 which includes means biasing said carriage against said movement to carry the wheels progressively, and thereby causing said wheels to exert a gathering force dependent on the force of said biasing means, brake means resisting axial movement of said backing collar with a limited resistance greater than said gathering force, and driving means for said packer means arranged to cause the packer collar to exert against the gathered sleeve material on the cartridge a thrust greater than the resistance of said brake means, so as to overcome such brake resistance and move the backing collar and cartridge along the support bar as a packing operation is completed.

* * * * *

UNITED STATES PATENT OFFICE

CERTIFICATE OF CORRECTION

Patent No. 4,089,108 Dated May 16, 1978

Inventor(s) Richard C. Overmyer and Mario Guerra

It is certified that error appears in the above-identified patent and that said Letters Patent are hereby corrected as shown below:

Column 2, line 20, change "23" to --24--.

Column 4, line 53, change "placec" to --placed--.

Column 5, line 41, change "against" to --again--.

Column 6, line 55 (Claim 3), change "whels" to --wheels--;

line 68 (Claim 4), after "toward the" at the end of the line, insert --stop end of the cartridge,--.

Column 7, line 7 (Claim 4), change "processes" to --progresses--.

Column 8, line 50 (Claim 12), change "thereof" to --thereon--.

Column 10, line 8, (Claim 14), change "sheels" to -- wheels --

Signed and Sealed this

Tenth Day of October 1978

[SEAL]

Attest:

RUTH C. MASON
Attesting Officer

DONALD W. BANNER
Commissioner of Patents and Trademarks